US005386878A

United States Patent [19]

Rowekamp

[11] Patent Number: 5,386,878

[45] Date of Patent: Feb. 7, 1995

[54] ROCK BORING PROCESS AND APPARATUS

[75] Inventor: Keith J. Rowekamp, Woodward, Okla.

[73] Assignee: UTI Energy Corp., Wayne, Pa.

[21] Appl. No.: 235,340

[22] Filed: Apr. 29, 1994

[51] Int. Cl.[6] ..... E21B 7/08

[52] U.S. Cl. ..... 175/62; 175/73

[58] Field of Search ..... 175/61, 62, 73–76, 175/122; 405/184, 138, 139

[56] References Cited

U.S. PATENT DOCUMENTS

| | | | |
|---|---|---|---|
| 3,092,190 | 6/1963 | Gruere | 175/62 |
| 3,507,342 | 4/1970 | Hasewend et al. . | |
| 3,550,698 | 12/1970 | Pauley . | |
| 3,905,431 | 9/1975 | Hasewend . | |
| 3,939,926 | 2/1976 | Barnes et al. | 175/73 X |
| 3,945,443 | 3/1976 | Barnes | 175/62 X |
| 4,091,631 | 5/1978 | Cherrington . | |
| 4,117,895 | 10/1978 | Ward et al. . | |
| 4,135,588 | 1/1979 | Wagner . | |
| 4,281,723 | 8/1981 | Edmond et al. . | |
| 4,867,255 | 9/1989 | Baker et al. . | |
| 4,953,638 | 9/1990 | Dunn . | |
| 5,033,556 | 7/1991 | Panzke . | |
| 5,042,597 | 8/1991 | Rehm et al. . | |

*Primary Examiner*—Michael Powell Buiz
*Attorney, Agent, or Firm*—Nies, Kurz, Bergert & Tamburro

[57] ABSTRACT

A horizontal earth boring machine which is capable of transferring drill cuttings from the boring area back through the machine to allow for more efficient boring through both hard and soft rock strata is disclosed. The earth boring machine has an air powered hammer bit drill with air passageways therethrough for flushing the boring area and also has a rotary drive for use in rotating augers secured inside a casing for transporting the drill cuttings back through the casing and out an air diverter discharge near the front of the machine. The machine is capable of movement along a track so as to facilitate the boring operation.

16 Claims, 4 Drawing Sheets

ROCK BORING PROCESS AND APPARATUS

BACKGROUND AND SUMMARY OF THE INVENTION

This invention is related to an earth boring process, more particularly to a process for efficiently performing horizontal earth boring.

Prior earth boring systems are shown, for example, in the following U.S. Pat. No. 3,507,342 to Hasewend et al; U.S. Pat. No. 3,550,698 to Pauley; U.S. Pat No. 3,905,431 to Hasewend; U.S. Pat. No. 4,091,631 to Cherrington; U.S. Pat. No. 4,117,895 to Ward et al; U.S. Pat. No. 4,135,588 to Wagner; U.S. Pat. No. 4,281,723 to Edmond et al; U.S. Pat. No. 4,867,255 to Baker et al; U.S. Pat. No. 4,953,638 to Dunn; U.S. Pat. No. 5,033,556 to Panzke; and U. S. Pat. No. 5,042,597 to Rehm et al.

Most prior art earth boring systems have used an auger drill for the boring operation. The auger drilling systems are typically slow, ineffective against hard, consolidated strata, and often do not result in a straight-through hole being bored. For example, if the auger hits rock, it typically moves up or down thus slowing the process and resulting in a bore which is misaligned.

Also, most prior art earth boring systems typically require repeated withdrawal of the drill head to remove debris accumulated during the boring process, thus slowing the boring process and requiring more labor time.

It is accordingly one object of the present invention to provide a horizontal boring method which can efficiently drill very hard rock strata as well as soft soil.

It is another object of the present invention to provide a horizontal boring system and method which uses a hammer bit type drill in place of the auger drill.

It is a further object of the present invention to provide a horizontal boring system in which air can be continuously supplied to the bore being drilled to remove debris and thus enhance and speed the drilling process.

It is still a further object of the present invention to provide a horizontal boring method in which a rotary auger system is used to transport debris accumulated during the boring process away from the area being bored.

DESCRIPTION OF THE PREFERRED EMBODIMENTS

Figure 1:
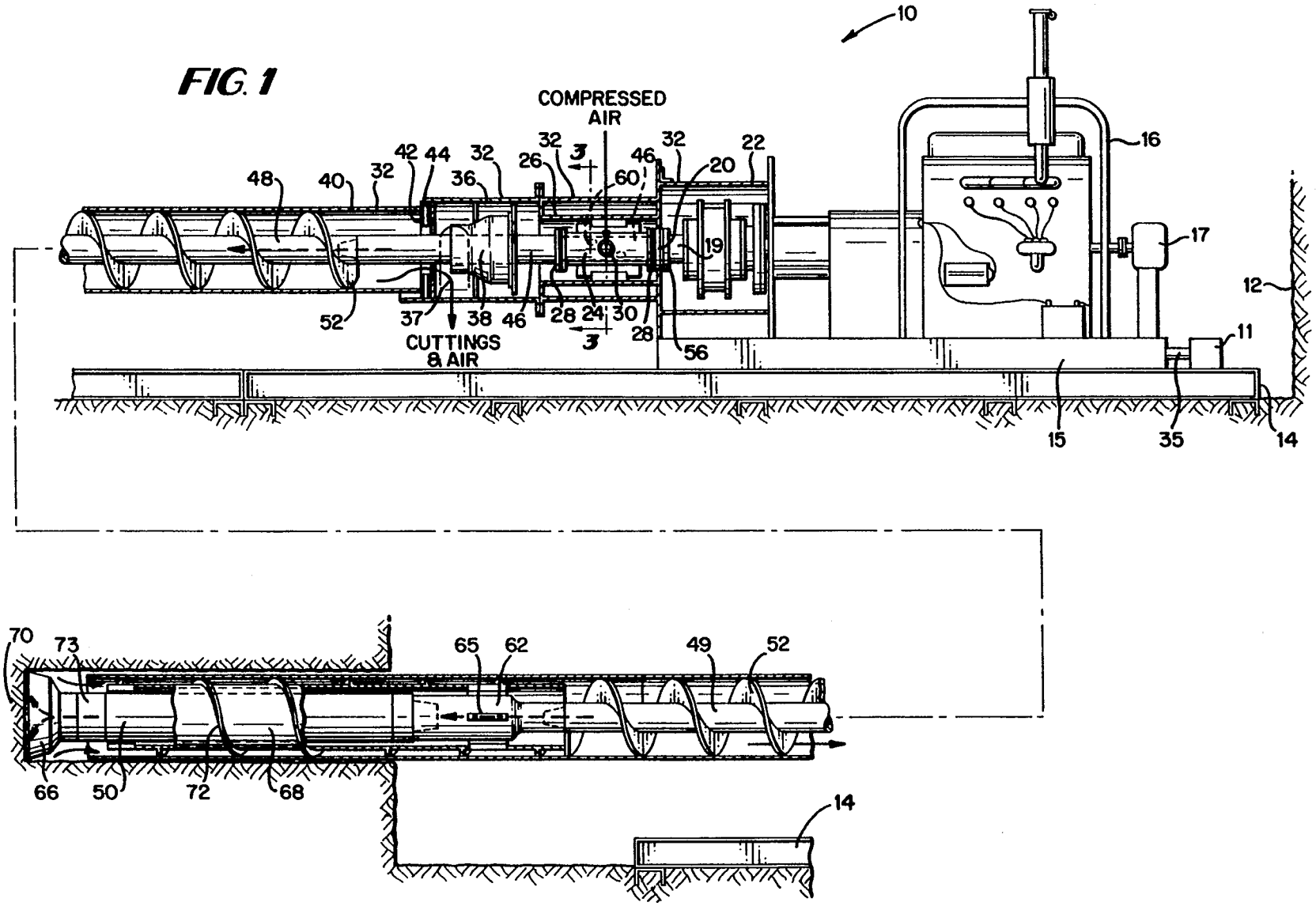
FIG. 1 shows a side elevation of the horizontal earth boring system of the present invention in partial cross-section, with the arrows denoting the direction of air passage.

Referring now to the invention as shown in FIGS. 1 through 6, there is provided a horizontal earth boring system 10 placed within a ditch 12. A bore track 14 is placed within the ditch 12 to allow a bore machine 16 of appropriate size to slide therealong.

Figure 5:
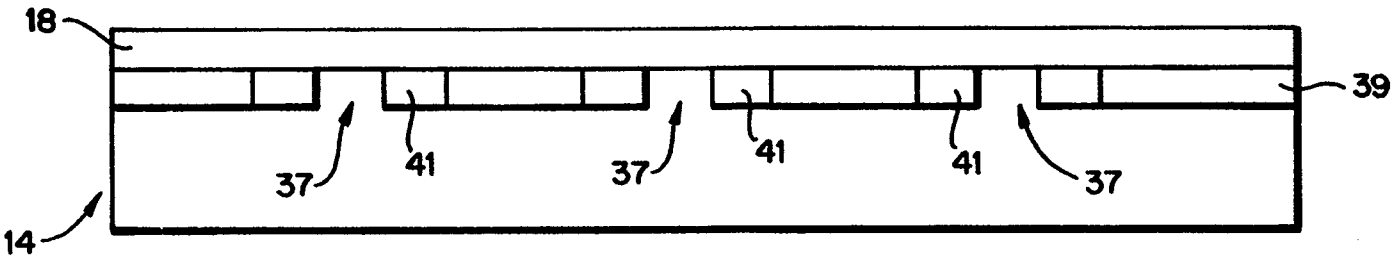
FIG. 5 is a side elevation showing the track and related components for moving the earth boring system of FIG. 1 along a ditch.
Figure 6:
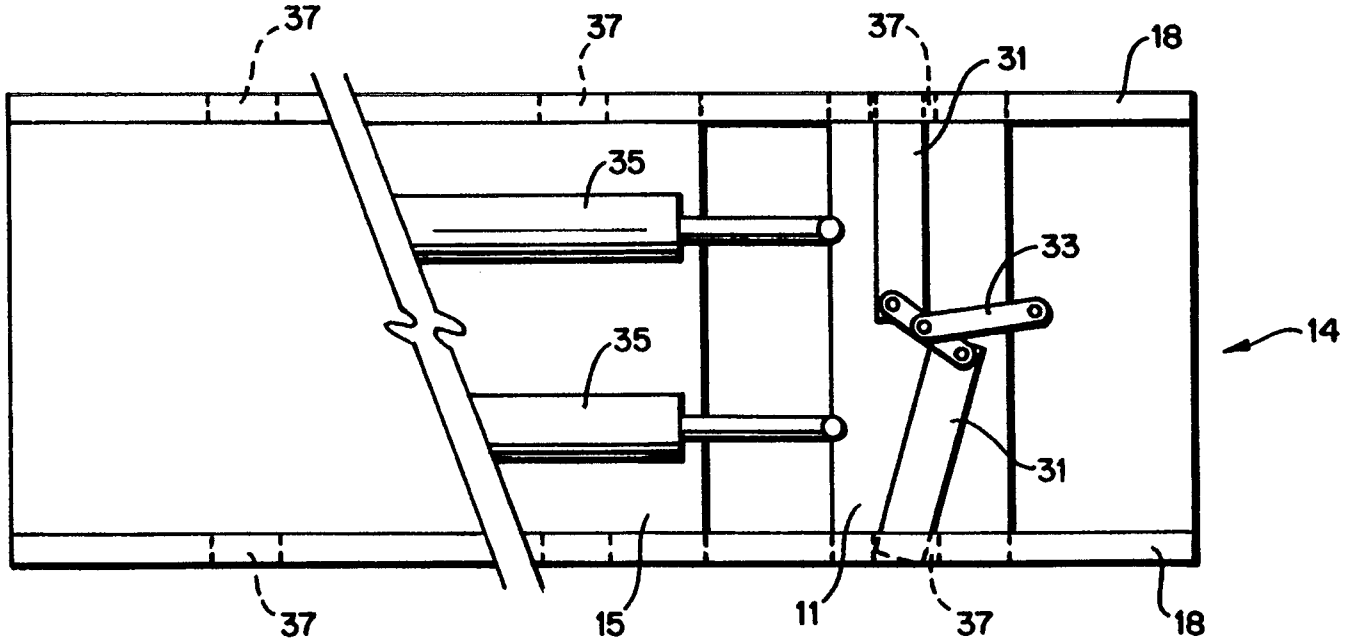
FIG. 6 is a top plan view of the track and related components shown in FIG. 5.

The bore machine 16 is placed on a bore machine skid 15 which travels in a bore track guide 18 of the bore track 14. As shown in FIGS. 5 and 6, a track lock box 11, also located within the track guide 18 in the upper inside portion of track 14, is provided with lock rods 31 and a lever 33 so that hydraulic cylinders 35 may be locked to the bore track guide 18 and thus have sufficient resistance with which to push or pull the bore machine skid 15 along the bore track guide 18. A series of openings 37 are provided along the length of the angle iron guide 39, with these openings 37 serving to receive the lock rods 31 so that the cylinders 35 may be releasably locked to the track 14 and thus allow the boring machine 16 to be pushed or pulled along the track 14. Angle iron braces 41 are also inserted for support in front and behind the push area 37 of the bore track guide 18. The lock box 11 is operated manually by pulling the lever 33 while the hydraulic cylinders 35 are operated by a hydraulic pump 17.

The hydraulic pump 17 also empowers the bore machine 16 itself, which provides the necessary rotary torque and compressive forces during operation. Conventional air compression equipment of appropriate size and pressure, located outside of the ditch 12, is utilized to provide the necessary compressed air to air inlet 30, as shown in FIG. 1, so as to empower an air hammer 50 at the end of the boring system 10 and to flush the boring area 70. A drive line housing 22, a rotary flow sub housing 26, an air diverter housing 36, and a carrier casing 40 are sequentially connected in a line extending from the bore machine 16 and form the outer shell 32 of the boring system 10.

A conventional drive line flexible coupling 20 connected to the bore machine 16 is encased in the drive line housing 22 and transmits torque from the bore machine 16 to the rest of the boring system 10 during operation. The drive line flexible coupling 20 is capable of tolerating misalignment, vibration, compression and limited tension. A rotary flow sub assembly 46 is attached to the drive line flexible coupling 20 and is maintained between a rotary flow sub flange 56 and a drive line 19 located in the drive line housing 22. The purpose of the rotary flow sub 46 is to provide a connection between the bore machine 16 and hollow stem augers 48, thus allowing the system to rotate while also allowing the flow of air under pressure into the hollow stem augers 48.

Figure 2:
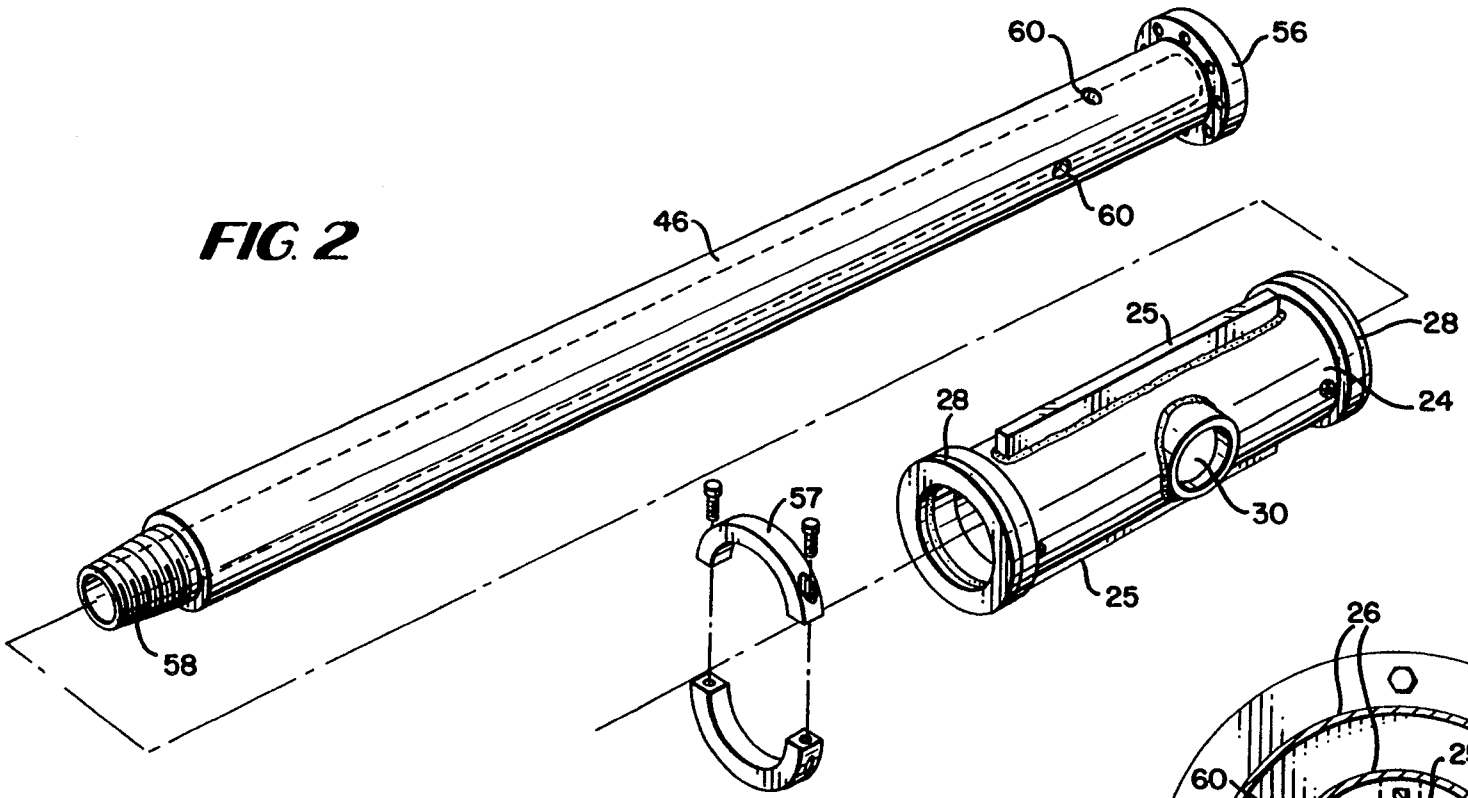
FIG. 2 shows an exploded perspective view of the rotary flow sub assembly of the present invention.
Figure 3:
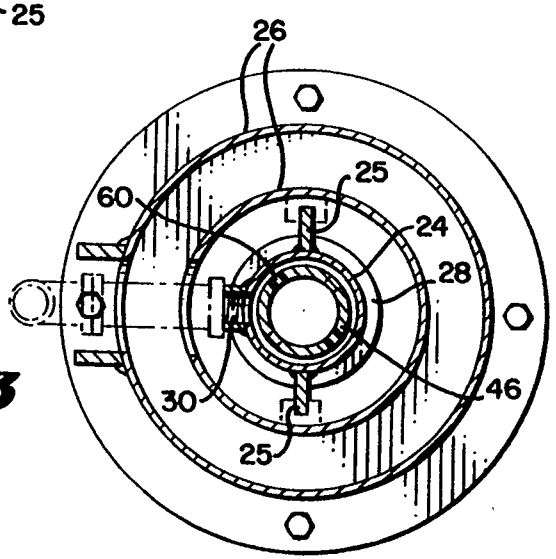
FIG. 3 shows an end elevation of a cross-section of the horizontal earth boring system of the present invention taken along line 3-3 of FIG. 1.
Figure 4:
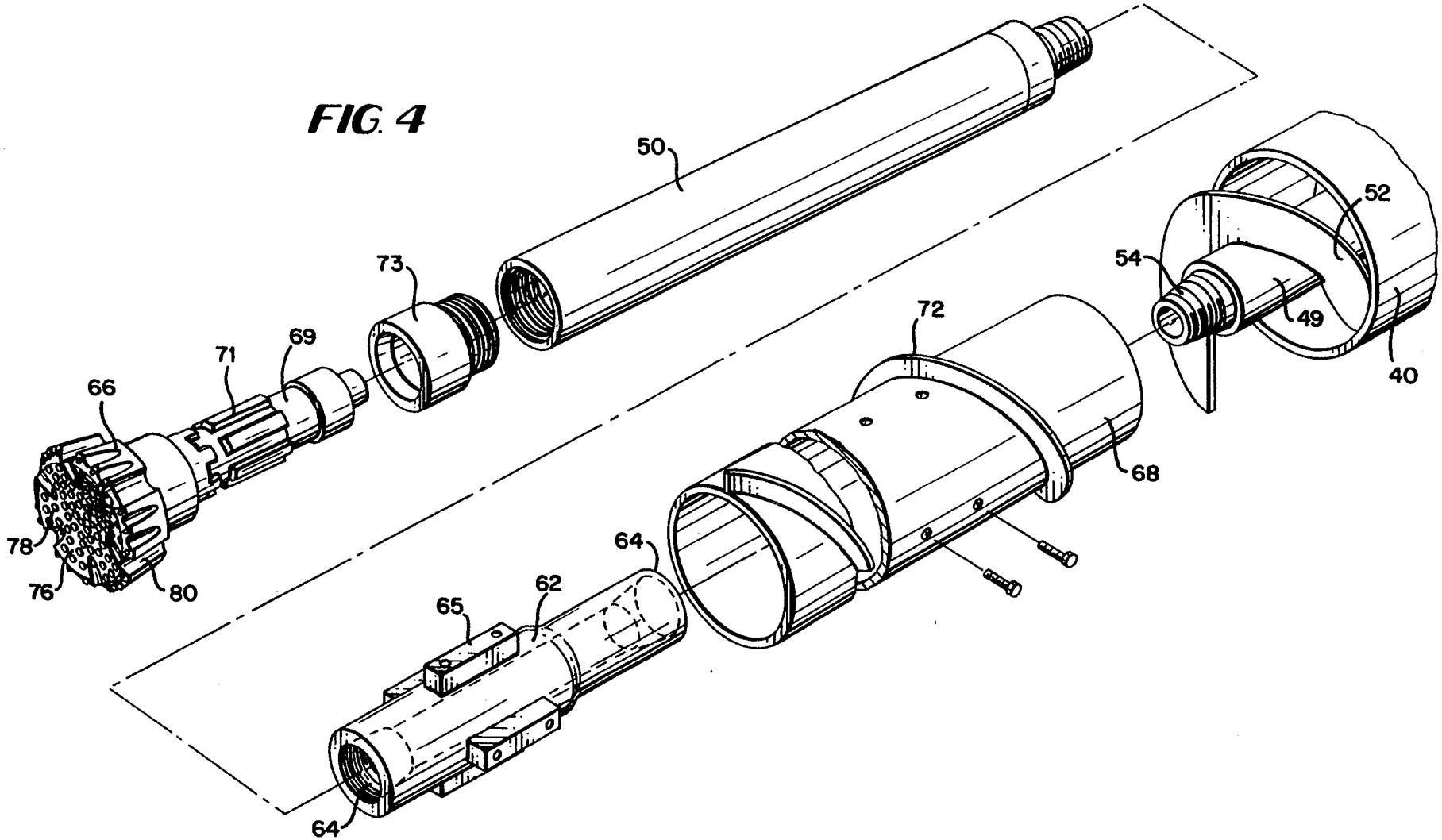
FIG. 4 shows an exploded perspective view of the air hammer configuration of the present invention.

The rotary flow sub 46 and the rotary flow sleeve 24 are together encased within the rotary flow sub housing 26, and the rotary flow sub 46 extends further axially through the air diverter housing 36 and into the carrier casing 40. The rotary flow sleeve 24 is provided with locking flanges 25 axially located on the outer diameter of the rotary flow sleeve 24 which lock the rotary flow sleeve 24 into the rotary flow sub housing 26 such that the rotary flow sleeve 24 remains stationary throughout operation. The rotary flow sleeve 24 is also provided with bearing and seal assemblies 28 having an 0-ring seal or similar sealing member on each end and an air inlet 30 on the side. The bearing and seal assemblies 28 allow the rotary flow sleeve 24 to develop positive air pressure when compressed air from the air compression equipment enters the air inlet 30. The rotary flow sub 46 is provided with a rotary flow sub flange 56 for connection to the drive line flexible coupling 20, which transmits the torque from the bore machine 10 to rotate the rotary flow sub 46 during operation. As shown in FIG. 2, the rotary flow sleeve 24 is maintained in position on the rotary flow sub 46 and over the air holes 60 by the bearing and seal assemblies 28 and by a retainer ring 57 secured around the rotary flow sub 46 adjacent one end of the rotary flow sleeve 24.

The air diverter housing 36 contains a discharge opening 37 and an air diverter packoff 38 which directs the flow of the discharge air and drill cuttings as they are returned from the inside of the carrier casing 40. The rotary flow sub 46 extends axially through the air diverter housing 36, the air diverter packoff 38, and into the carrier casing 40. The front 44 of the air diverter housing 36 is also used as a push plate for the carrier casing 40.

A carrier casing load indicator 42 is attached to the front 44 of the air diverter housing 36. The casing load indicator 42 determines the force exerted on the carrier casing 40 independently of the total force exerted on the boring system 10 as the boring system 10 moves along the track 14. This aids in determining the appropriate force to be applied to the air hammer 50 and the hammer bit 66 located at the end of the air hammer 50. The carrier casing 40 is attached to the casing load indicator 42 and is used, in part, to advance the hammer bit 66 toward the rock to be bored.

The rotary flow sub 46, besides having a rotary flow sub flange 56 on the drive end for connection with the drive line flexible coupling 20, is also provided with a male API threaded connection on the auger end 58. Also, the rotary flow sub 46 is provided with a series of holes 60 bored perpendicularly to the axis of the rotary flow sub 46. During operation, the rotary flow sub 46 rotates inside the rotary flow sleeve 24 and air provided by the air compression equipment flows through the inlet 30 of the rotary flow sleeve 24, through the holes 60 of the rotary flow sub 46 and subsequently through the interior of a series of hollow stem augers 48.

The series of hollow stem augers 48 is attached to the auger end 58 of the rotary flow sub 46 inside of the carrier casing 40. The hollow stem augers 48 are capable of transporting air to power the air hammer 50 and, when rotated, transport drill cuttings away from the boring area 70 through the aid of appropriately sized outside diameter auger flights 52 welded to the outside diameter of the hollow stem augers 48. Each hollow stem auger 48 has ends 54 provided with standard API threaded connections machined to facilitate connecting the hollow stem augers 48 in end to end fashion. In a specific embodiment of the invention, each hollow stem auger 48 is twenty feet long with a four inch outside diameter and a three inch inside diameter.

The last hollow stem auger 49 in the series of hollow stem augers 48 is attached to a crossover driver sub 62. The crossover driver sub 62 has two threaded ends 64 and serves as the connection between the last hollow stem auger 49 and the air hammer 50. The air hammer 50 uses compressed air from the air compression equipment which travels through the rotary flow sub 46 and the hollow stem augers 48 to create a repetitive percussion force, similar to a jackhammer, which is transferred to the boring area 70 through the hammer bit 66. The air hammer 50 and the crossover driver sub 62 are encased by a hammer tool auger sleeve 68 which transports the drill cuttings from the boring area 70 to the last hollow stem auger 48. The crossover driver sub 62 is provided with connection flanges 65 on its outer diameter to allow for a secure attachment to the hammer tool auger sleeve 68. This allows the hammer tool auger sleeve 68 to rotate with the hollow stem augers 48, the air hammer 50 and the hammer bit 66. The outside diameter of the auger sleeve 68 is provided with helical auger flights 72 to aid in the transporting process. The crossover driver sub 62 also incorporates a change of thread type from the air hammer 50 to the hollow stem augers 49. The auger sleeve 68, the air hammer 50, and the crossover driver sub 62 are, in turn, all encased by the carrier casing 40, which does not rotate during operation.

At the end of the air hammer 50 is a hammer bit 66. The hammer bit 66 has a shaft portion 69 on which are located splines 71 for mating with a spline member 73 of the air hammer 50. The hammer bit 66 has a face 76 located outside of the auger sleeve 68 and the carrier casing 40 on which are located inserts 78 which protrude from the face 76 of the hammer bit 66 and which aid in the boring of solid rock strata. In one embodiment of the invention, these inserts 78 are made of tungsten carbide. Additionally, the hammer bit face 76 has air grooves 80 for allowing the passage of air around the hammer bit face 76.

In operation, compressed air is supplied to the air inlet 30 by the air compression equipment and flows through the rotary flow sleeve 24, the rotary flow sub 46, the hollow stem augers 48 and the crossover driver sub 62 where it empowers the air hammer 50. The air hammer 50 then operates to pound the hammer bit 66 into the boring area 70. As the hammer bit 66 impacts the boring area 70, it creates drill cuttings which fall into the air grooves 80 and are transported by the moving air to the auger flights 72 and 52.

As the compressed air further travels through the air hammer 50 and the hammer bit 66, it is forced to the side where it flushes the boring area 70 of the drill cuttings and sends the drill cuttings rearwardly into the carrier casing 40. Once inside the carrier casing 40, the bore machine 16 rotates the rotary flow sub 46 which rotates the augers 72 on the hammer tool auger sleeve 68 as well as the hollow stem augers 48. This action sends the drill cuttings further rearwardly through the carrier casing 40 and into the air diverter housing 36 where the drill cuttings and the air flow are directed by the air diverter packoff 38 through the discharge opening 37 in the air diverter housing 36. This obviates having to repeatedly withdraw the boring system 10 from the boring area 70 during operation to add auger flights or extend the length of the bore hole.

As the hammer bit 66 penetrates the boring area 70, the hydraulic pump 17 pushes the bore machine 16 along the track 14 in the direction of the drilling activity while additional carrier casing 40 and hollow stem augers 48 are installed. As the hydraulic pump 17 extends the hydraulic cylinders 35 to their limits, the lock box 11 may be manually moved further down the bore track guide 18 by use of the lever 33 to provide support for further extension of the hydraulic cylinders 35.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An earth boring machine comprising:

a bore machine;

a cylindrical rotary flow member having front and rear end portions, wherein the front end is rotatably mounted on said bore machine, said rotary flow member having at least one air inlet along the length thereof for passage of air into the interior of said rotary flow member;

a cylindrical rotary flow sleeve member coaxially mounted and spaced radially outwardly from the exterior of said rotary flow member, said sleeve member having an air inlet and with sealing means for providing air tight engagement of the ends of said sleeve member with said rotary flow member; and means for maintaining said sleeve member in a fixed, non-rotating condition with respect to said rotary flow member.

2. The earth boring machine of claim 1 wherein said rotary flow member is disposed horizontally.

3. The earth boring machine of claim 1 wherein at least one hollow stem auger is rotatably mounted on the rear end of said rotary flow member.

4. The earth boring machine of claim 1 further including means for providing air under pressure to the air inlet of said sleeve member.

5. The earth boring machine of claim 1 wherein said bore machine is mounted on a track, and including means for moving said bore machine along the track.

6. The earth boring machine of claim 3, further including driving tool means connected to said at least one hollow stem auger, said driving tool means having an air hammer portion.

7. An earth boring machine for movement along a track located in a ditch or other level working area, comprising:

a boring unit mounted for movement along said track, said boring unit having a rotary drive means;

a rotary member having front and rear end portions, said front end being mounted on said boring unit, and with said rotary member having an air inlet valve;

a pneumatic drive means connected to said air inlet valve;

an air diverter member having front and rear end portions, and having an air discharge, said front end of said air diverter member being connected to said rear end of said rotary member;

a casing connected to the rear end of said air diverter member;

at least one hollow stem auger attached to said rear end of said rotary member and extending axially through said casing;

at least one auger flight secured on said at least one hollow stem auger for rotating drill cuttings back through said casing and out through said air discharge; and driving tool means connected to said at least one hollow stem auger, said driving tool means having air passageways to allow the flow of air provided by said pneumatic means to pass through said rotary member and said at least one hollow stem auger.

8. The earth boring machine of claim 7 wherein said boring unit, said rotary member, said at least one hollow stem auger, said driving tool means, and said casing are in axial alignment.

9. The earth boring machine of claim 7 wherein said rotary member includes a rotary flow sub housing having front and rear end portions, a rotary flow sleeve fixedly mounted within said rotary flow sub housing, and a cylindrical rotary flow member extending axially through said rotary flow sleeve and into said carrier casing where said rotary flow sub attaches to said at least one hollow stem auger.

10. The earth boring machine of claim 9 wherein said air diverter member has an air diverter packoff therein, said air diverter packoff being capable of receiving said rotary flow sub therethrough.

11. The earth boring machine of claim 10 wherein a casing load indicator having front and rear end portions is connected between said air diverter member and said casing such that said front end of said casing load indicator is attached to said rear end of said air diverter and said rear end of said casing load indicator is connected to said casing.

12. The earth boring machine of claim 9 wherein said rotary flow member is provided with at least one air inlet.

13. The earth boring machine of claim 7 wherein said driving tool means comprises:

a crossover driver sub connected to said at least one hollow stem auger, said crossover sub being located within said casing, an air hammer connected to said crossover driver sub, said air hammer having a bit end and being located within said casing, and an air hammer bit connected to and extending from said bit end of said air hammer, said air hammer bit extending outside of said casing.

14. The earth boring machine of claim 13 wherein said air hammer bit includes a face portion having protruding inserts.

15. A method of horizontal earth boring which comprises:

(a) providing a horizontally disposed boring unit having a rotary drive and mounted for movement along a track located in a ditch or other generally level working area;

(b) mounting a cylindrical rotary flow member for rotation on said boring unit, said rotary flow member having at least one air inlet along the length thereof for passage of air into the interior of said rotary flow member, and with a rotary flow sleeve member coaxially mounted in a fixed, non-rotating condition with respect to said rotary flow member and spaced radially outwardly from the exterior of said rotary flow member, said sleeve member having an air inlet and with sealing means for providing air tight engagement of the ends of said sleeve member with said rotary flow member;

(c) mounting at least one hollow stem auger for rotation on said rotary flow member, with the interior of said hollow stem auger being in fluid communication with the interior of said rotary flow member;

(d) mounting a driving tool means to said at least one hollow stem auger; and (e) providing air under pressure to the air inlet of said rotary flow sleeve member.

16. The method of claim 15 wherein said driving tool means projects drill cuttings rearwardly to the area of said hollow stem auger which carries the cuttings rearwardly for discharge, thus avoiding the necessity for repeatedly withdrawing the driving tool means during operation.

* * * * *